United States Patent [19]

Jenne

[11] Patent Number: 4,462,468

[45] Date of Patent: Jul. 31, 1984

[54] RAM HEAD FOR SELF-DRIVEN PNEUMATIC RAM DRILLS

[76] Inventor: Gustav Jenne, Schmachtenbergstrasse 183, 4300 Essen-Kettwig, Fed. Rep. of Germany

[21] Appl. No.: 388,829

[22] Filed: Jun. 16, 1982

[30] Foreign Application Priority Data

Jun. 23, 1981 [DE] Fed. Rep. of Germany ..... 3124524

[51] Int. Cl.[3] ..... B25D 9/04

[52] U.S. Cl. ..... 173/121; 173/126; 173/129; 173/131

[58] Field of Search ..... 173/125, 126, 128, 130, 173/131, 132, 133, 13, 14, 119; 175/171, 19; 299/94, 381; 37/2 R, 2 P

[56] References Cited

U.S. PATENT DOCUMENTS

| | | | |
|---|---|---|---|
| 1,372,257 | 3/1921 | Swisher | 175/381 |
| 3,765,493 | 10/1973 | Rosar et al. | 175/381 |
| 3,865,200 | 2/1975 | Schmidt | 175/19 |
| 4,036,310 | 7/1977 | Schnell | 173/131 |
| 4,193,461 | 3/1980 | Lamberton et al. . | |

FOREIGN PATENT DOCUMENTS

| | | | |
|---|---|---|---|
| 627546 | 3/1936 | Fed. Rep. of Germany . | |
| 2558842 | 7/1977 | Fed. Rep. of Germany | 175/19 |
| 356009 | 9/1931 | United Kingdom | 175/381 |

OTHER PUBLICATIONS

German Newspaper "Baupraxis", vol. 11, 1978, (Willispecht-Ziegenaue Erdbohrungen), pp. 16-17.

*Primary Examiner*—Frank T. Yost
*Assistant Examiner*—Hien H. Phan
*Attorney, Agent, or Firm*—Martin A. Farber

[57] ABSTRACT

A ram head for self-driven pneumatic ram drills for producing boreholes in the earth, having a generally tubular housing within which there is movable axially back and forth an impact piston whose impact energy can be transmitted to the ram head arranged at the front end of the housing. In order on the one hand, to crush obstacles by high energy and, on the other hand, to avoid too strong a compacting of small particles of earth in front of the apparatus and in addition make it possible to drive pipes, the generally conical ram head is provided with a central axial bore within which an impact bolt is mounted for longitudinal displacement between two end positions which are limited by stops, at the front end position of which supported by a spring the impingement surface of the impact bolt for the impact piston lies within the anvil surface of the ram head and at the rear end position of which the impingement surface projects from the anvil surface in the direction towards the impact piston.

13 Claims, 4 Drawing Figures

1
2
3
3a
3b
3c
3d
3e
3f
4
4a
4b
5
6

RAM HEAD FOR SELF-DRIVEN PNEUMATIC RAM DRILLS

BACKGROUND OF THE INVENTION

1. Field of the Invention

The present invention relates to a ram head for self-driven pneumatic ram drills for producing boreholes in the earth, having a generally tubular housing within which there is movable axially back and forth an impact piston whose impact energy can be transferred to the ram head which is arranged at the front end of the housing.

2. Description of the Prior Art

Self-driven pneumatic ram drills are known in various embodiments and with different developments of the ram head. Aside from ogival ram heads, there are slightly conical ram heads with flat or possibly slightly recessed front surface. Finally ram heads are known which are displaceable freely or under spring action by a certain amount with respect to the housing of the ram drill.

Ram heads which are, as a whole, longitudinally displaceable with respect to the housing are intended to make certain that obstacles in the soil are crushed more easily since the impact energy of the impact piston acts only on the mass of the ram head, which is small as compared with the entire ram drill, so that the large mass of the housing is moved axially forward only after the obstacle has been already split. This manner of operation applies, however, only for certain types of soil. Particularly in the case of finely granular and compactly stratified sandy soils a ram head which is longitudinally displaceable with respect to the housing produces the result that the soil is initially compacted even more by the impact momentum in front of the ram drill and that thereafter the subsoil is merely elastically deformed. In these cases, the ram head moves forward under the action of the impact momentum of the impact piston and then back again under the energy of resilience of the soil without the actual ram drill achieving any axial advance.

Completely different behavior is obtained under these limiting conditions with a ram drill whose ram head is firmly connected to the housing. Due to the conical development of the ram head, the device wedges itself forward, the lateral wedge force displacing the earth sidewards in front of the ram head without excessive compacting. The wall friction on the periphery of the housing of the ram drill prevents the housing from being pushed back and forth axially under the action of the slight forces of resiliency. The disadvantage of these ram heads which are firmly connected with the housing as compared with ram drills with longitudinally displaceable ram heads is not only the smaller crushing power but, in particular, the very slight stability in travel in a non-homogeneous subsoil.

Aside from their use for producing holes in the earth, the ram drills have another desirable possibility of use as a ram. In this case the ram head of the ram drill transmits the impact momentum via a suitable transition piece into a pipe to be driven and drives it into the soil. A ram drill with longitudinally displaceable impact point is not well suited for this use since the ram head is under the constant danger of breaking off and converts a considerable part of the introduced ramming energy into deformations and transverse oscillations. Furthermore, a longitudinally displaceable ram head cannot be axially connected with a pipe by a self-locking taper connection, while a ram head which is firmly connected with the housing and has an outer taper, for instance of a slope of 1:10, can be readily driven from the rear into a pipe of suitable diameter by ramming strokes, a connection which is resistant to axial thrust between the ram head and the pipe to be driven being produced by the taper wedge force. Only such a connection affords the possibility of connecting a ram drill firmly to a pipe to be driven, particularly a steel pipe, so that the recoil force of the compressed air which moves the impact piston within the ram drill can no longer loosen the connection made.

The object of the present invention is to develop a ram head for self-driven pneumatic ram drills in such a manner, while avoiding the disadvantages of the known prior art, that while on the one hand it splits obstacles present in the earth with high energy and crushes them, on the other hand it avoids excessive compacting of small grains of earth in front of the ram drill and, in addition, makes it possible to drive pipes with an axially force-locked connection.

SUMMARY OF THE INVENTION

The attainment of this objective by the invention is characterized by the generally conical ram head being provided with a central axial bore within which an impact bolt is mounted for longitudinal displacement between two end positions which are limited by stops, at the frontmost of which end positions, which is supported by a spring, the impingement surface of the impact bolt for the impact piston lies within the anvil surface of the ram head while at its rear end position the impingement surface projects from the anvil surface in the direction towards the impact bolt.

By this development of the ram head in accordance with the invention the result is obtained that by the penetration of the ram drill into the earth, the impact bolt is pushed back by the resistance of the earth so that the impact of the impact piston primarily acts on the small impingement surface of the impact bolt, the impact bolt thus transmitting very high crushing and splitting energy to crush and displace stones or other inclusions in the earth. The ram drill equipped with the ram head in accordance with the invention has in this case, i.e. in non-homogeneous soils, a high stability of travel. In the case of fine-granular and densely compacted sandy soils only a small amount of resistance is present in front of the tip of the impact bolt so that upon impingement of the impact piston it easily moves forward and practically the entire ramming energy of the impact piston is transmitted into the ramming head which converts it into displacement and thrust forces. In this case the slightly conical formation of the ram head which is rigidly connected with the housing acts so that lateral wedging forces displace the earth sidewards, without excessive compacting in front of the ram drill, as a result of which a good continuous movement of the ram drill is obtained.

With the driving of pipes and upon the expanding of boreholes by means of enlargement sleeves the conical outer contour of the ram head produces a good connection with the pipe or the enlargement sleeve. The tip of the impact bolt is not imparted any frontal resistance so that the impact bolt remains in its frontmost end position as a result of the spring load. The impact piston therefore strikes exclusively on the anvil surface of the ram head so that, as a result of the wedging of the conical ram head to the inner wall of the pipe or the enlargement sleeve, the entire ram energy of the impact bolt is converted into thrust force for the pipe or the enlargement sleeve.

In accordance with another feature of the invention, the anvil surface of the ram head is at least three times as large as the impingement surface of the impact bolt. In this way the further advantage is obtained that practically only axial forces and no moments of flexure are introduced into the relatively thin impact bolt. In this way a long life of the impact bolt is assured, while with the previously known longitudinally displaceable ram heads very large moments of flexure had to be transmitted due to unilaterally acting obstacles such as pebbles and rock, which can lead to fatigue fractures after only a short period of use. The distribution of the impact energy of the impact piston over the impact bolt on the one hand and the ram head on the other hand can be controlled by the initial tension of the spring.

The outer contour of the ram head can, in accordance with another feature of the invention, be provided with a tapering comprised of successive steps as known per se. This step-like tapering has the advantage, for instance upon the driving of pipes, that the ram head can be placed on pipes of different inside diameters.

In a preferred embodiment of the invention, the stop which limits the rear end position of the impact bolt is formed by an annular collar arranged on the impact bolt and cooperating with an annular stop surface on the ram head. This particularly simple structural development has the advantage that, in accordance with another feature of the invention, the annular collar serves at the same time as stop for the front end of the spring which is arranged as coil spring on the impact bolt and the rear end of which abuts against the ram head. Finally, it is proposed by the invention to develop the stop which limits the front end position of the impact bolt as a rear thickening developed on the impact bolt and cooperating with an annular, preferably oblique stop surface in the ram head.

By the proposal in accordance with the invention there is created a ram head which, with high stability of travel of the ram drill in non-homogeneous earth, produces very high crushing work while in finely granular as well as tightly compacted sandy soils it avoids undesired compacting in front of the ram head so as to obtain a large advance of drilling. The impact bolt used to obtain these advantages is inactive when the ram head is used for the driving of pipes or for the enlarging of boreholes, so that optimum results are obtained also for this purpose of use as a result of the conical development of the ram head.

BRIEF DESCRIPTION OF THE DRAWINGS

With the above and other objects and advantages in view, the present invention will become more clearly understood in connection with the detailed description of a preferred embodiment, when considered with the accompanying drawings, of which.

DESCRIPTION OF THE PREFERRED EMBODIMENTS

The only part of the ram drill shown is the front part of a generally tubular housing 1 in which an impact piston 2, only the front part of which is shown, is guided for movement back and forth. The impact piston 2 receives its impact energy by the feeding of compressed air to the housing 1. Since known measures and designs are involved here, a description of the rear part of the housing 1 has to this extent been dispensed with.

Figure 3:
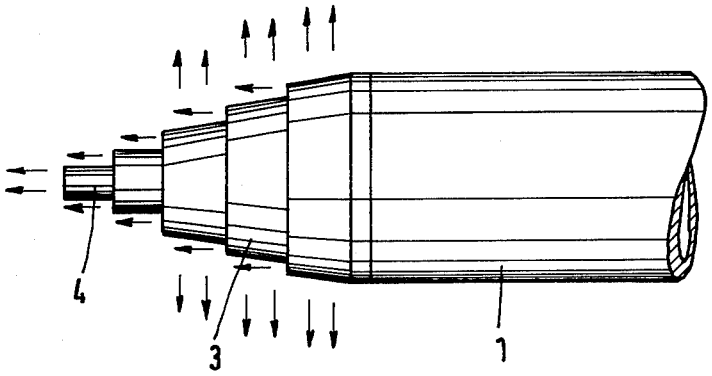
FIG. 3 a diagrammatic showing of the action of the ram head upon the displacement of earth.
Figure 4:
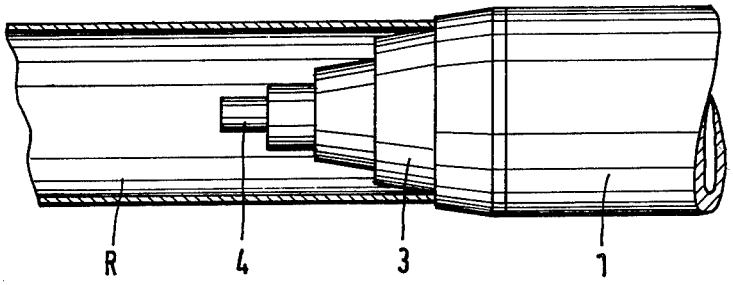
FIG. 4 is a side view of the ram head during the driving of a steel pipe.

A ram head 3 is arranged at the front end of the housing 1. This ram head 3 can either be screwed detachably into the front end of the housing 1, as shown in the illustrative embodiment, or else it can be permanently attached to the housing 1. The outer contour of the ram head 3 has a generally conical shape, despite the development of different steps 3*a*. These steps 3*a*, which are also slightly conical, follow the conical contour and have the result, as shown in FIG. 3, that the forces exerted by the ram head 3 of the earth are converted in part into forward-driving work and in part into displacement work, as indicated by the arrows in FIG. 3. Furthermore, these steps 3*a* afford the possibility, as shown in FIG. 4, of placing the ram head 3 on pipes R of different inside diameter, a firm wedge attachment between the pipe R and ram head 3 being obtained upon the driving of the pipe R as a result of the conical development of each of the steps 3*a*.

The ram head 3 is provided with a central axial bore 3*b* in which an impact bolt 4 is mounted for longitudinal displacement between two end positions. This impact bolt 4 has a cross section which is small compared with the ram head 3 and is biased by the force of a spring 5 which presses it into its front end position, shown in FIG. 1.

The two end positions of the impact bolt 4 relative to the ram head 3 are obtained by engagement against stops. In the embodiment shown, the stop which defines the front end position of the impact bolt 4 is developed as a thickened portion 4*a* on the rear end of the impact bolt 4. This thickened portion 4*a* cooperates with an annular stop surface 3*c* which has been produced by an enlargement of the axial bore 3*b* at its rear end. The stop surface 3*c* and, accordingly, the surface of the thickened portion 4*a* which cooperates with it, are inclined to the longitudinal axis of the ram head 3, resulting in an enlargement of this stop surface.

The stop which defines the rear end position of the impact bolt 4 is formed, in the embodiment shown in the drawing, by an annular collar 6 arranged on the impact bolt 4. In the embodiment shown, this annular collar 6 is screwed onto the impact bolt 4 at a distance from its tip. The rear end of the annular collar 6 cooperates with an annular stop surface 3*d* in the ram head 3, which in its turn is formed by a widening of the axial bore 3*b* - this time at the front end of the ram head 3.

Behind this stop surface 3*d*, the ram head 3 has a widening relative to the axial bore 3*b*, within which the spring 5 is arranged. This spring 5 is developed as a coil spring and rests at one end against the rear end surface of the annular collar 6 and on the other end against a corresponding annular surface 3*e* on the ram head 3.

Figures 1, 2:
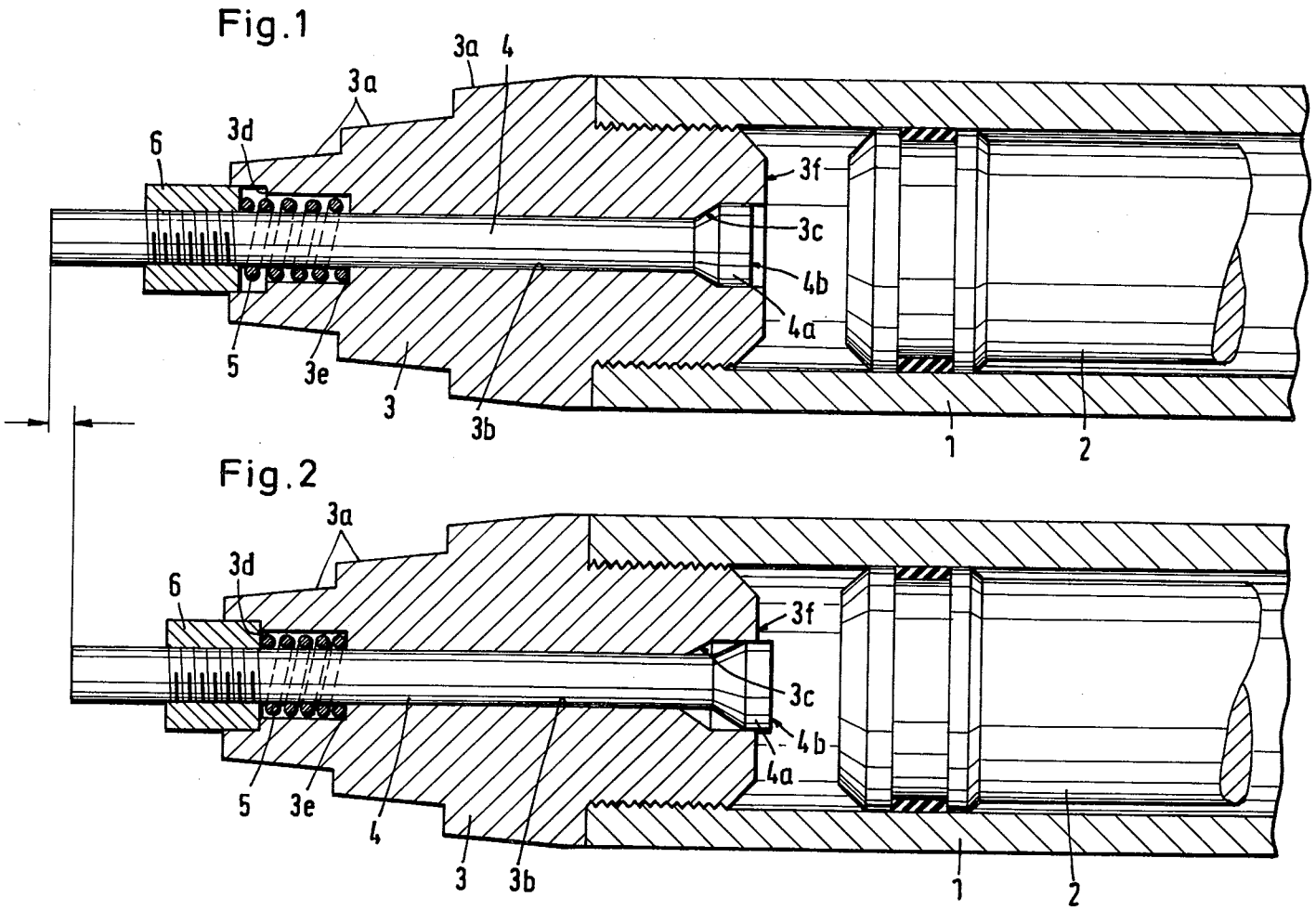
FIG. 1 is a longitudinal section through the front part of a ram drill broken away in part and provided with the ram head of the invention, the impact bolt being in its front end position.
FIG. 2 is a partial section corresponding to FIG. 1 in which the impact bolt, however, has been pushed back into its rear end position relative to the ram head as the result of an obstacle present in front of it.

When the ram drill equipped with the ram head 3 described above is used to produce boreholes in finely granular and compactly stratified sandy earths, the spring 5, via the annular collar 6, presses the impact bolt 4 into its front end position, shown in FIG. 1. In this front end position, the impingement surface 4*b* lies within and in front of the anvil surface 3*f* of the ram head 3 so that the impinging impact piston 2 transfers its energy completely to the ram head 3. The impact bolt 4 essentially performs only displacement work, as can be noted from FIG. 3.

On the other hand, if the impact bolt 4 of the ram head 3 strikes against a solid obstacle in the earth, the impact bolt 4 is pushed back, against the force of the spring 5, into its rear end position relative to the ram head 3, as shown in FIG. 2. When the impact piston 2 now transmits its impact energy to the ram head 3, it first of all strikes against the impingement surface 4*b* of the impact bolt 4 so that the tip of the impact bolt transmits a concentrated crushing and chiseling force into the subsoil. As soon as the crushing work has been performed, the axial load on the impact bolt 4 is reduced so that it is pressed back by the force of the spring 5 into its front-most end position shown in FIG. 1 and the ram head 3 as a whole performs the necessary displacement and advancing work.

As a result of its small cross section and its stable mounting free of transverse vibrations, the impact bolt 4 can transmit very large axial crushing and splitting forces and thus chisel free the path for the ram drill even when obstacles of high strength are embedded in the earth. In the case of homogeneous soils, on the other hand, the conical outer contour of the ram head 3 goes fully into action so that optimum advance is obtained under these conditions.

When the ram head 3 is used for the driving of pipes, as shown in FIG. 4, the impact bolt 4 also produces no effect. It is held in its front end position by the spring 5 while the entire impact energy is transmitted into the pipe R via one of the steps 3*a* of the ram head 3.

Differing from the embodiment shown, the tip of the impact bolt 4 can also be conical. Instead of the rear thickening 4*a* it is also possible to make the annular collar 6 in one piece with the impact bolt 4 and to cement, place or screw a collar on the impact bolt 4 as the rear stop.

I claim:

1. In a ram head for self-driven pneumatic ram drills for producing boreholes in the earth, arranged at the front end of a substantially tubular housing within which an impact piston is movable axially back and forth transmitting impact energy to an anvil surface of the ram head, the ram head being substantially conical and formed with a central axial bore therethrough, an impact bolt being longitudinally displaceably mounted between a front end position and a rear end position thereof in said axial bore, stop means for limiting said impact bolt in said end positions, and spring means supported against the ram head and biasing said impact bolt, the improvement wherein said impact bolt having an impingement surface facing the impact piston, said spring means being arranged between said ram head and said impact bolt such that, respectively:

said spring means presses said impact bolt so that said impingement surface is inside said anvil surface of said ram head in said front end position during and constituting a normal position; and said impingement surface projects beyond said anvil surface in a direction towards said impact piston in said rear end position counter to the biasing of said spring means in another position.

2. The ram head according to claim 1, wherein said anvil surface of said ram head is at least three times as large as said impingement surface of said impact bolt.

3. The ram head according to claim 1, wherein said ram head has a tapering outer contour formed with steps which follow a substantially conical tapering shape.

4. The ram head according to claim 1, wherein said stop means comprise, an annular stop surface defined by a widening of said central axial bore and an annular collar on said impact bolt, said annular stop surface and said annular collar abut against each other limiting said impact bolt in the rear end position of said impact bolt.

5. The ram head according to claim 4, wherein said spring means comprises a coil spring disposed on said impact bolt, said spring has a rear end engaging against said ram head and a front end engaging against said annular collar.

6. The ram head according to claim 4, wherein said annular collar arranged on said impact bolt comprises a separate piece therefrom, screwed thereon.

7. The ram head according to claim 1, wherein said stop means includes, an annular stop surface defined by an enlargement of said central axial bore in said ram head and a rear thickened portion formed on said impact bolt abutting said annular stop surface of said ram head in and limiting said impact bolt in said front end position thereof.

8. The ram head according to claim 7, wherein said annular stop surface is inclined with respect to said central axial bore.

9. The ram head according to claim 8, wherein said rear thickened portion of said impact bolt has a frustoconical section, and said annular stop surface is a frustoconical section complementary to that of said rear thickened portion.

10. The ram head according to claim 7, wherein said annular stop surface is inclined by an acute angle with respect to the longitudinal axis of the ram head.

11. The ram head according to claim 1, wherein said stop means includes, an annular stop surface defined by an enlargement of said central axial bore in said ram head and a collar arranged on said impact bolt abutting said annular stop surface of said ram head and limiting said impact bolt in said front end position thereof.

12. The ram head according to claim 11, wherein said collar is a separate piece, screwed onto said impact bolt.

13. The ram head according to claim 11, wherein said annular stop surface is inclined by an acute angle with respect to the longitudinal axis of the ram head.

* * * * *